US008179415B2

(12) United States Patent
Yamaguchi et al.

(10) Patent No.: US 8,179,415 B2
(45) Date of Patent: May 15, 2012

(54) EXPOSURE HEAD AND IMAGE FORMING APPARATUS

(75) Inventors: Kenji Yamaguchi, Matsumoto (JP); Nozomu Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 12/610,988

(22) Filed: Nov. 2, 2009

(65) Prior Publication Data

US 2010/0135699 A1 Jun. 3, 2010

(30) Foreign Application Priority Data

Dec. 3, 2008 (JP) ..... 2008-308261

(51) Int. Cl.
*B41J 2/45* (2006.01)

(52) U.S. Cl. ..... 347/238

(58) Field of Classification Search ..... 347/229, 347/234, 238, 249, 236–237, 246–248
See application file for complete search history.

(56) References Cited

U.S. PATENT DOCUMENTS 5,119,108 A * 6/1992 Hatakeyama ..... 347/211
5,260,718 A * 11/1993 Rommelmann et al. ..... 347/136
5,450,099 A * 9/1995 Stephenson et al. ..... 347/200
5,825,400 A * 10/1998 Florence ..... 347/239
7,038,706 B1 * 5/2006 Hiyoshi ..... 347/238
7,248,277 B2 * 7/2007 Ishikawa ..... 347/238
7,327,377 B2 * 2/2008 Matsumoto ..... 347/238
7,388,686 B2 * 6/2008 Saquib et al. ..... 358/1.8

FOREIGN PATENT DOCUMENTS

JP 2000-158705 6/2000
JP 2008-036937 2/2008
JP 2008-173889 7/2008
JP 2008173889 A * 7/2008

* cited by examiner

*Primary Examiner* — Hai C Pham
(74) *Attorney, Agent, or Firm* — DLA Piper LLP (US)

(57) ABSTRACT

An exposure head includes: a group of light emitting elements in which light emitting elements are arranged in a first direction; a light emitting element substrate in which the group of light emitting elements is arranged in the first direction and in a second direction orthogonal or substantially orthogonal to the first direction; and a driving substrate which drives the light emitting elements arranged on the light emitting element substrate, wherein the driving substrate controls a light emission intensity of a light emitting element that is near to an end side in the first direction of the group of the light emitting elements, among the light emitting elements constituting the group of the light emitting elements, so that the intensity is smaller than the light emission intensity of a light emitting element constituting the group of the light emitting elements different from the above light emitting element, and the light emission intensity becomes smaller towards the end side.

7 Claims, 10 Drawing Sheets

EXPOSURE HEAD AND IMAGE FORMING APPARATUS

BACKGROUND

1. Technical Field

The present invention relates to an exposure head and an image forming apparatus which forms a latent image on a photoconductor by using lenses which image the light emitted from light emitting elements arranged in a predetermined pitch.

2. Related Art

As small light emitting elements are linearly arranged in a predetermined pitch and light emitted from each of the light emitting elements are imaged by lenses, it is possible to form one line of an imaged spot column on an image plane. Techniques for forming a latent image on a surface of a photoconductor using such principles have been developed. For example, in JP-A-2000-158705, it is possible to form a desired latent image by blinking the light emitting elements arranged linearly on an exposure head at an appropriate timing while rotating a cylindrically shaped photoconductor.

Also, in a case in which each of the light emitting elements has a dedicated imaging lens, the diameter of lens becomes small, so that it is not possible to increase the number of numerical aperture (NA number) of the lens. Accordingly, an exposure head which can secure a large NA number by the shared use of one imaging lens by a predetermined number of light emitting elements and thus considerably improve the resolution of latent image is proposed in, for example, JP-A-2008-036937. In this proposed exposure head, due to the following reasons, the groups of a predetermined number of light emitting elements (hereinafter, referred to "light emitting element array") are obliquely arranged differently from each other. First, the end portion of the lens is not provided with a light emitting element array since it has a low imaging capability. Thus, first, imaging lenses are linearly arranged and a predetermined number of light emitting elements (light emitting element array) are arranged only in the vicinity of a center portion of each lens. In this state, since the boundary line portion between the lenses is not provided with the light emitting element array, a similar imaging lens column is arranged in the immediate vicinity of the imaging lens column with a slight deviation, and the boundary line portion between the lenses is filled by light emitting element array of a newly arranged imaging lens column. Focusing on the light emitting element array, a plural of light emitting element arrays are arranged in a zigzag pattern. Of course, if the addition of only one line of a new imaging lens column is not sufficient to accomplish the filling in, more imaging lens columns may be added. In this case, the plural number of light emitting element arrays are repeatedly arranged obliquely with a positional deviation with each other.

Further, in the exposure head in which the light emitting element arrays are arranged to be different from each other, if the exposure head is obliquely assembled in a plane parallel to the surface of the photoconductor (in a state that it is rotated about an axis having a direction towards the photoconductor), it is possible to see the emitting element arrays arranged differently from each other in the oblique direction, and thus the sections in which a space are generated between the light emitting element arrays widens and/or narrows. As a result, the section in which groups of imaging spots formed by each light emitting element array are separated and its near section are generated in a latent image of the photoconductor. Alternatively, in a case of forming a long imaging lens column by connecting a plurality of relatively short imaging lens columns rather than forming an imaging lens column integrally, a deviation in a lens pitch occurs at a connected portion, which causes the occurrence of the sections in which the distance between the spot groups has widened or narrowed, and thus it is difficult to form a good latent image.

In consideration of the above description, another technique, for example, in JP-2008-173889 is known, in which an end of a light emitting element array is slightly extended and a light emitting element overlapped with the emitting element of another light emitting element array (an overlapped element) is provided. In a case in which the distance between the spot groups is widened and thus a gap appeared, the gap is filled by forming a spot by means of the overlapped element, whereas in a case in which the distance between the spot groups is narrowed, a spot in that portion is thinned out, whereby degradation of image quality of a latent image is avoided.

However, there is a problem that it is difficult to obtain a sufficiently good latent image only by forming a spot by the overlapped element provided at an end of the light emitting element array or thinning out the spot. The reason is that, as is apparent from the above-described mechanism, even when the distance between the spot groups is widened, the distance can have various values. For example, in a case of forming a spot of the overlapped element since a space between the spot groups is slightly widened, the pitch of the spot at that portion is conversely narrowed. Further, there occurs a case in which providing one spot of the overlapped element is not sufficient, but providing two spots of the overlapped element is excessive. Similarly, in a case of thinning out one spot since a distance between the spot groups has narrowed, the pitch of the spot at that portion is conversely widened. Of course, there occurs a case in which thinning out one spot is not sufficient, but thinning out two spots is excessive.

SUMMARY

An advantage of some aspects of the invention is to provide a technique which uses an exposure head equipped with a plurality of light emitting element arrays which forms the spots appropriately so that sufficiently good latent image can be obtained.

According to a first aspect of the invention, there is provided an exposure head, comprising: a group of light emitting elements in which light emitting elements are arranged in a first direction; a light emitting element substrate in which the group of light emitting elements is arranged in the first direction and in a second direction orthogonal or substantially orthogonal to the first direction; and a driving substrate which drives the light emitting elements arranged on the light emitting element substrate, wherein the driving substrate controls a light emission intensity of a light emitting element that is near to an end side in the first direction of the group of the light emitting elements, among the light emitting elements constituting the group of the light emitting elements, so that the intensity is smaller than the light emission intensity of a light emitting element constituting the group of the light emitting elements different from the above light emitting element, and the light emission intensity becomes smaller towards the end side.

In the exposure head of the invention with such a configuration, the light emitting elements constituting the group of the light emitting elements arranged on the light emitting element substrate are driven by the driving substrate. In this way, the light emitting elements are driven such that the light emission intensity of the light emitting element that is near to an end side in the first direction of the group of the light emitting elements, among the light emitting elements constituting the group of the light emitting elements, is made smaller than that of a light emitting element constituting the group of the light emitting elements different from the above light emitting element, and the light emission intensity becomes smaller towards the end side.

When a latent image is formed using such an exposure head, in a portion between the groups of the light emitting elements at which the light emitting elements are overlapped, the latent images are formed in an overlapped manner by the light emitting elements of the two groups of the light emitting elements. Each group of the light emitting elements is set such that as the light emitting element is located towards an end of the group, its light intensity is weakened. Thus, in a portion at which two groups of the light emitting elements are overlapped to form a latent image, transition is gradually performed from a state in which a latent image is mainly formed by one side of a group of light emitting elements to a state in which a latent image is mainly formed by the other side of a group of light emitting elements. Accordingly, even though the latent image formed by one side of a group of light emitting elements and the latent image formed by the other side of a group of light emitting elements move close to or away from each other, its effect is gradually alleviated in a portion at which two groups of light emitting elements are overlapped, and thus does not substantially affect image quality.

Further, in this exposure head of the invention with the above-described configuration, the group of light emitting elements may be arranged to be separated by a constant distance in the first direction.

With this configuration, as long as the groups of light emitting elements overlapped each other are at least adjacently arranged, the number of overlapped light emitting elements becomes identical in all groups of light emitting elements. Generally, although a plurality of the overlapped portions of a group of light emitting elements are provided in an exposure head, if the number of the overlapped light emitting elements are all the same, it is correspondingly possible to easily drive the light emitting elements in the overlapped portion.

Further, considering that the above described exposure head is used for forming an, image on a printing medium, it is possible to understand the invention in an aspect of an image forming apparatus. According to a second aspect of the invention, there is provided an image forming apparatus, comprising: a latent image carrier on which a latent image is formed; an exposure head including a first group of light emitting elements in which light emitting elements are arranged in a first direction, a first imaging optical system which images the first group of light emitting elements, a second group of light emitting elements which emit light to form a second latent image which is partly overlapped with the first latent image formed on the latent image carrier by light from the first group of light emitting elements by the first imaging optical system, and a second group of imaging optical system which images the second group of light emitting elements; and a driving control unit which controls an amount of light from the light emitting elements which emit light to be imaged at a position at which the first latent image and the second latent image are overlapped such that its light emission intensity is smaller than that of an amount of light from the light emitting elements which emit light to be imaged at a position at which the first latent image and the second latent image are not overlapped.

In the image forming apparatus of the invention having such a configuration, in a portion at which the groups of the light emitting elements are overlapped, latent images are formed in an overlapped manner by two groups of the light emitting elements. Each group of the light emitting elements is driven such that as the light emitting element is located towards an end of the group, its light intensity is weakened. Thus, in a portion at which two groups of the light emitting elements are overlapped, transition is gradually performed from a state in which a latent image is mainly formed by one side of a group of light emitting elements to a state in which a latent image is mainly formed by the other side of a group of light emitting elements. Accordingly, even though the latent image formed by one side of a group of light emitting elements and the latent image formed by the other side of a group of light emitting elements move close to or away from each other, its effect is gradually alleviated in a portion at which two groups of light emitting elements are overlapped. As a result, it is possible to form a high quality image by using such a latent image.

Further, in this image forming apparatus of the invention, a driving control unit may be constituted as follows. The driving control unit may include: an image reading unit which reads image data; a bit image data generating unit which generates bit image data which is data indicating a pixel which forms a bit on the basis of the image data; and a bit image data converting unit which detects overlapped dot bit image data which is emitted by the light emitting elements of the first group of the light emitting elements which emits light to be imaged at a position at which a first latent image and a second latent image are overlapped, among the bit image data generated in the bit image data generating unit, generates the same data as the detected overlapped dot bit image data, and inserts it into the bit image data which is emitted by the light emitting elements of the second group of the light emitting elements which emits light to be imaged at a position at which a first latent image and a second latent image are overlapped, whereby the bit image data of the second group of light emitting elements is converted.

With this configuration, in regard to the light emitting elements in the overlapped portion, it is possible to drive an exposure head so that as the light emitting element is located towards an end of a group of light emitting elements, its light intensity is weakened, and thus a high quality image can be formed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, in order to clarify the above-described contents of the invention, an embodiment of the invention will be described according to following sequence.

A. Configuration of an apparatus
A-1. Structure of an image forming apparatus
A-2. Structure of an exposure head
B. Summary of forming a latent image
C. Method of driving an exposure head in this embodiment
D. Summary of data processing

A. Configuration of an Apparatus

A-1. Structure of an Image Forming Apparatus

Figure 1:
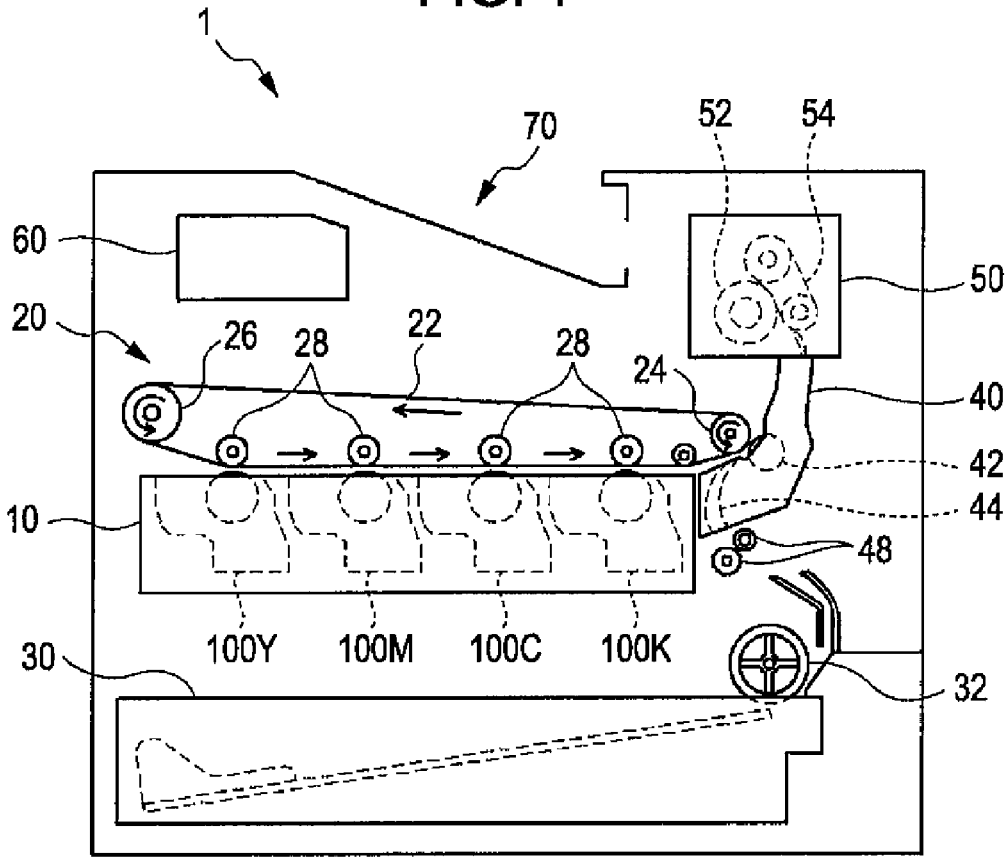
FIG. 1 is an explanatory view illustrating a schematic structure of an image forming apparatus equipped with an exposure head according to an embodiment.

FIG. 1 is an explanatory view illustrating a schematic structure of an image forming apparatus 1 equipped with an exposure head according to an embodiment. As shown in FIG. 1, an image forming apparatus 1 includes an image forming unit 10 with a substantially rectangular parallelepiped shape provided at a center of the apparatus, a transfer belt unit 20 provided at an upper surface side of the image forming unit 10, a paper feed unit 30 provided under the image forming unit 10, a secondary transfer unit 40 provided at a side of the image forming unit 10 and the transfer belt unit 20, and a fixing unit 50 provided above the secondary transfer unit 40. Also, a control unit 60 that controls operations of each unit may be provided inside of the image forming apparatus 1.

The transfer belt unit 20 is constituted by a transfer belt 22 which is provided extended between a driving roller 24 and a driven roller 26. When the transfer belt 22 is driven by the driving roller 24 and passes over an upper surface of the image forming unit 10, a toner image formed by the image forming unit 10 is transferred onto the transfer belt 22. Also, at this time, in order to reliably transfer a toner image of the image forming unit 10 onto the transfer belt 22, the transfer belt 22 is supported at its rear side by a first transfer roller 28.

A photoconductive cartridge for forming a toner image is provided in the image forming unit 10. The image forming unit 10 of the image forming apparatus 1 shown in FIG. 1 includes a photoconductive cartridge 100Y which forms a toner image of a yellow color, a photoconductive cartridge 100M which forms a toner image of a magenta color, a photoconductive cartridge 100C which forms a toner image of a cyan color, and a photoconductive cartridge 100K which forms a toner image of a black color. Also, these photoconductive cartridges of various colors have identical basic structure except that colors of used toners are different from each other. Thus, hereinafter, except for the time when it is necessary to distinguish the colors from each other, they will be designated simply as a photoconductive cartridge 100. As will be described later in detail, a cylindrical shaped photoconductive drum is provided in the photoconductive cartridge 100 and a toner image is formed on a surface of the photoconductive drum. As the photoconductive drum rotates correspondingly to movement of the transfer belt 22, a toner image on a surface of the photoconductive drum is transferred to a transfer belt 22. Since the image forming apparatus 1 shown in FIG. 1 includes a photoconductive cartridge 100Y for a yellow color, a photoconductive cartridge 100M for a magenta color, a photoconductive cartridge 3000 for a cyan color, and a photoconductive cartridge 100K for a black color, the toner images with the respective colors are transferred onto the transfer belt 22 in the order of the above colors and in an overlapped manner. In this way, a portion to which the toner images have been transferred is fed to the secondary transfer unit 40 in accordance with the rotation of the transfer belt 22.

The secondary transfer unit 40 includes a secondary transfer roller 42 provided at a position facing the driving roller 24, and a guide passageway 44 to guide a printing paper to the section (the portion at which the driving roller 24 and the secondary transfer roller 42 face each other). After the printing paper is taken out one by one from a downward paper feed unit 30 by a pickup roller 32 and fed to a pair of an upward storage rollers 48, it is fed at an appropriate timing from the pair of the storage rollers 48 through the guide passageway 44 to a region between the driving roller 24 and the secondary transfer roller 42. As a result, the toner image which has been transferred (primary transfer) onto a surface of the transfer belt 22 is then transferred onto the printing paper (secondary transfer). The printing paper onto which the toner image has been transferred as described above is fed to a fixing unit 50.

The fixing unit 50 includes a heating roller 52 in which a heating unit such as a halogen heater is built in, and a pressing unit 54 which presses the printing paper against the heating roller 52. The printing paper from the secondary transfer unit 40 is fed to a region between a rotating heating roller 52 and the pressing unit 54, pressed by the pressing unit 54 at an appropriate pressure and passed over the rotating heating roller 52. At this time, the toner image which has been transferred onto the surface of the printing paper receives heat from the rotating heating roller 52 and thus is fixed to the printing paper. The printing paper which has been fixed is ejected to a paper catch tray 70 provided on an upper surface of the image forming apparatus 1.

Figure 2:
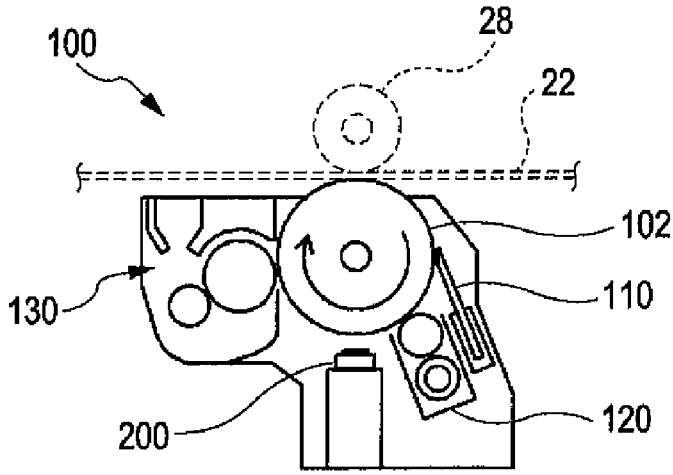
FIG. 2 is an explanatory view illustrating a structure of a photoconductive cartridge.

FIG. 2 is an explanatory view illustrating a structure of a photoconductive cartridge 100. As shown in FIG. 2, a cylindrical shaped photoconductive drum 102 is provided near the center of the photoconductive cartridge 100. The photoconductive drum 102 can be rotated by a dedicated driving motor (not shown), and a toner image is transferred onto a surface of the photoconductive drum 102. Various components for forming a toner image are mounted around the photoconductive drum 102. With reference to FIG. 2, a photoconductive cleaner 110 is provided at a right side of the photoconductive drum 102. From this position, a charging unit 120, an exposure head 200, and a developing unit 130 are provided in a clockwise direction.

The photoconductive cleaner 110 comes into contact with a surface of the photoconductive drum 102 and has a function to remove residual toner on a surface of the photoconductive drum 102. Prior to forming a toner image on a surface of the photoconductive drum 102, a surface of the drum is cleaned at a position of the photoconductive cleaner 110. After the toner and the like on the surface are removed by the photoconductive cleaner 110 as the photoconductive drum 102 rotates, the surface is moved to the charging unit 120.

The charging unit 120 includes a charging roller which has a circumferential surface which is covered by elastic rubber, and a charging bias applying unit which applies a charging bias to the charging roller. In a state in which the charging roller comes into contact with the photoconductive drum 102, the charging roller rotates in response to the rotation of the photoconductive drum 102, and it is possible to charge the surface of the photoconductive drum 102 by applying a charging bias to the charging roller. This charged surface is moved to the exposure head 200.

As will be explained later with regard to a detailed structure of the exposure head 200, the exposure head 200 is a long component in which a plurality of light emitting elements and imaging lenses are linearly arranged, and is arranged such that there is a gap between the exposure head and the surface of the photoconductive drum 102 and the imaging lenses face the surface of the drum. When light emitted from the light emitting element is imaged on a surface of the photoconductive drum 102 using an imaging lens, that portion is discharged to form a latent image on the surface of the photoconductive drum 102. The surface with such a latent image formed thereon is sent to the developing unit 130 by the rotation of the photoconductive drum 102.

The developing unit 130 includes a developing roller which comes into contact with the photoconductive drum 102 and rotates therewith, and a friction roller which comes into contact with the developing roller and rotates therewith. When the developing roller and the friction roller rotate, toner in the developing unit 130 is charged by friction and carried onto a surface of the developing roller. At this time, a charged polarity of the toner is determined depending on the toner material and material of the friction roller and the developing roller. Also, the polarity of the charging bias which is applied to the photoconductive drum 102 in the charging unit 120 is set to the same polarity as the polarity which discharges the toner. As the surface of the developing roller on which the toner has been carried comes into contact with a surface of the photoconductive drum 102, the toner of the developing roller is transferred only to a latent image portion, and thus a toner image is formed on a surface of the photoconductive drum 102. Since a surface of the photoconductive drum 102 is charged with the same polarity as that of the friction-charged toner, the toner is not transferred to a portion at which a latent image is not formed, from the developing roller to the photoconductive drum 102. Also, a developing bias is applied to a region between the developing roller and the photoconductive drum 102 so that the toner of the developing roller can be reliably transferred to a portion of latent image. In corresponding to this, the developing unit 130 further includes a developing bias applying unit for generating a developing bias (not shown).

The toner image which has been formed on a surface of the photoconductive drum 102 is sent to a position of the transfer belt 22 by rotation of the photoconductive drum 102, and then transferred onto the transfer belt 22 supported at its rear side by the first transfer roller 28. Then, it is sent to a portion of the photoconductive cleaner 110 in order to form a new toner image again, and the residual toner on the surface is removed. Thereafter, by passing through the charging unit 120, the exposure head 200, the developing unit 130 in this order, a new toner image is formed.

A-2. Structure of an Image Forming Apparatus

Figure 3A:
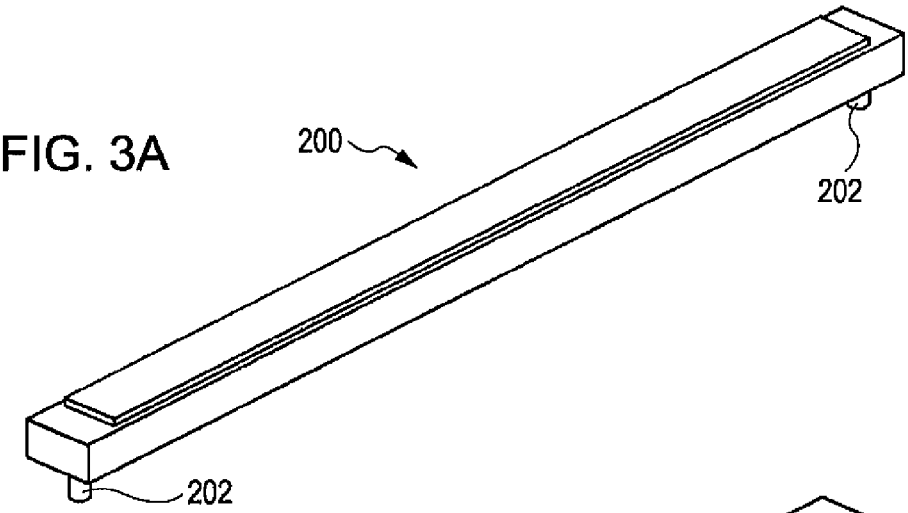
FIGS. 3A and 3B are explanatory views illustrating a structure of an exposure head which is mounted on an image forming apparatus according to an embodiment.
Figure 3B:
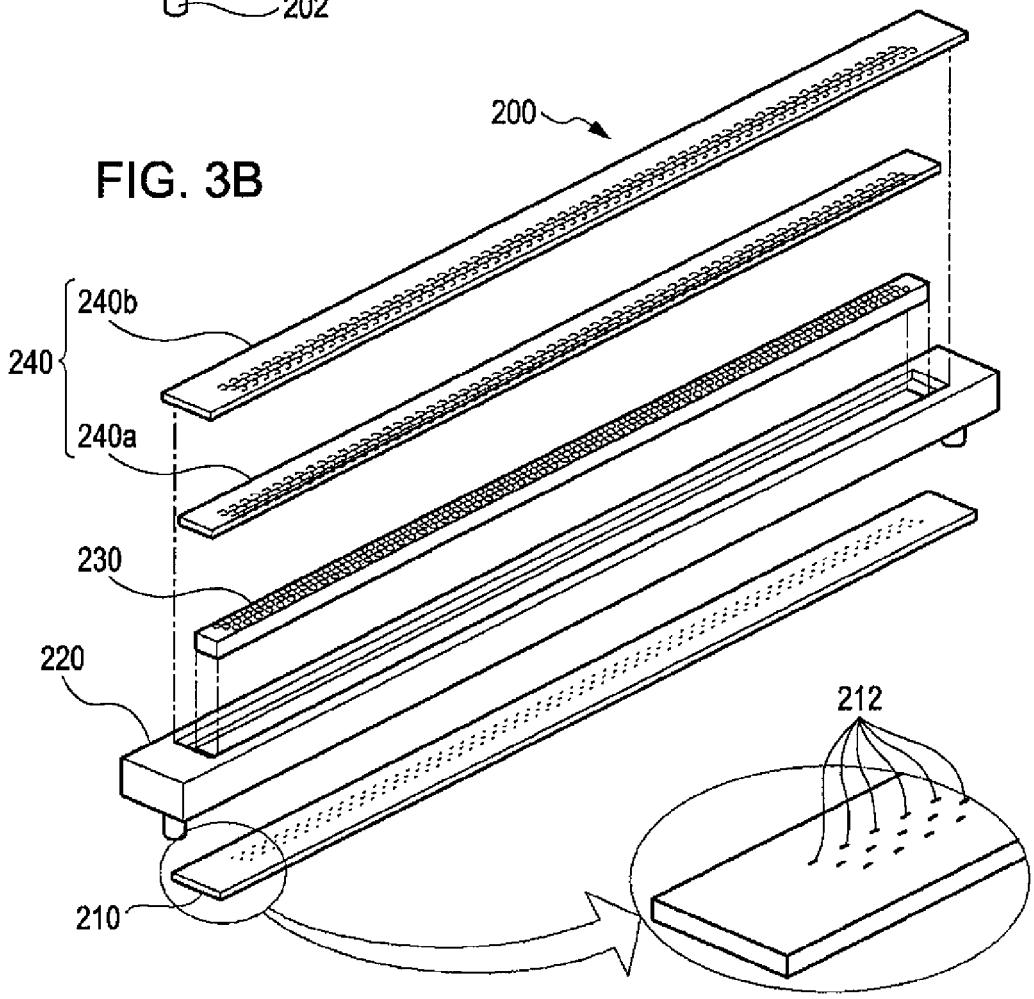

FIGS. 3A and 3B are explanatory views illustrating a structure of an exposure head 200 which is mounted on an image forming apparatus 1 according to the embodiment. FIG. 3A shows an external configuration of an exposure head 200 according to the embodiment and FIG. 3B shows a breakdown, view of the exposure head 200. As shown in FIG. 3A, the exposure head 200 according to the embodiment has a substantially rectangular parallelepiped shape, and includes small positioning protrusions 202 on a bottom surface side at both ends. The exposure head is positioned by the protrusions 202 and attached to a photoconductive cartridge 100.

The exposure head 200 is configured such that an elongated rectangular light emitting element substrate 210, a primary lens array plate 240*a*, on which small imaging lenses are formed, and a secondary lens array plate 240*b*, on which small imaging lenses are formed, are stacked on a head case 220 with a predetermined space between them. To explain this in detail with reference to FIG. 3B, the head case 220 is formed in an elongated frame shape. A light emitting element substrate 210 is stacked on a bottom surface side of the head case 220. As shown in an enlarged manner in FIG. 3B, the light emitting element substrate 210 has a plurality of light emitting element arrays 212 in a predetermined arrangement in which micro light emitting elements are linearly arranged. Arrangement of the light emitting element arrays 212 will be discussed later.

An elongated rectangular shaped light shielding member 230 is provided over the light emitting element substrate 210. The light shielding member 230 is made of an opaque material and has a plurality of small circular penetration holes at positions which the light emitting element array 212 is located on the light emitting element substrate 210 such that the light emitted from each of the light emitting element arrays 212 can pass through.

A primary lens array plate 240*a* is provided over the light shielding member 230 and a secondary lens array plate 240*b* is provided over the primary lens array plate 240*a*. The primary lens array plate 240*a* and the secondary lens array plate 240*b* are positioned by the head case 220. The light emitting element array 212, the primary lens array plate 240*a*, the secondary lens array plate 240*b* are arranged to be separated by predetermined distance. The primary lens array plate 240*a* and the secondary lens array plate 240*b* are made of a transparent resin material, and include a plurality of small imaging lenses on a surface thereof at positions facing the penetration holes of the light shielding member 230. Accordingly, the light emitted froth the light emitting element array 212 of the light emitting element substrate 210 passes through the penetration hole of the light shielding member 230, passes through the imaging lens of the primary lens array plate 240*a* and the imaging lens of the secondary lens array plate 240*b*, and is irradiated on a surface of the photoconductive drum 102.

Further, in this embodiment of exposure head 200, although two lens array plates, i.e. the primary lens array plate 240*a* and the secondary lens array plate 240*b* are employed to increase the degree of freedom in lens design, one collective lens array plate may be employed. In regard to this, hereinafter, the primary lens array plate 240*a* and the secondary lens array plate 240*b* are collectively designated as a lens array plate 240.

Figure 4:
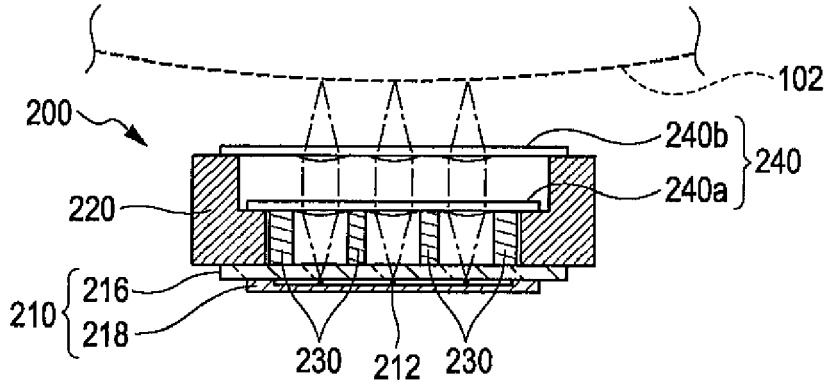
FIG. 4 is an explanatory view illustrating a sectional structure of the exposure head.

FIG. 4 is an explanatory view illustrating a sectional structure of the exposure head 200. As shown in FIG. 4, the light emitting element substrate 210 includes a transparent glass substrate 216 and a sealing plate 218 which is stacked on a rear side of the glass substrate 216, the light emitting element arrays 212 being arranged between the glass substrate 216 and the sealing plate 218. Further, the light emitting element substrate 210 also includes a driving circuit for driving each light emitting element constituting a light emitting element array 212. The light emitted from each light emitting element of the light emitting element array 212 passes through the glass substrate 216, passes through the penetration hole of the light shielding member 230, converges into substantially parallel light by an imaging lens provided on a surface of the primary lens array plate 240*a*, again converges by an imaging lens provided on a surface of the secondary lens array plate 240*b*, and is focused on a surface of the photoconductive drum 102. Also, as shown in FIG. 4, the imaging lens provided on the primary lens array plate 240*a* and the light emitting element array 212 are separated by a light shielding member 230 which is formed from an opaque material and is disposed between them. Thus, the light emitted from the light emitting element array 212 is incident at an imaging lens provided at a corresponding position.

FIG. 5 is an explanatory view illustrating arrangement of a plurality of imaging lenses provided on a lens array plate 240. As shown, three lines of small imaging lenses are arranged on a lens array plate 240 of this embodiment. The lens pitch in each line is set to be "p" and each line is arranged with a phase deviation by a distance corresponding to one third of the lens pitch "p". Also, a distance between adjacent lines is set to be "s".

Figure 5A:
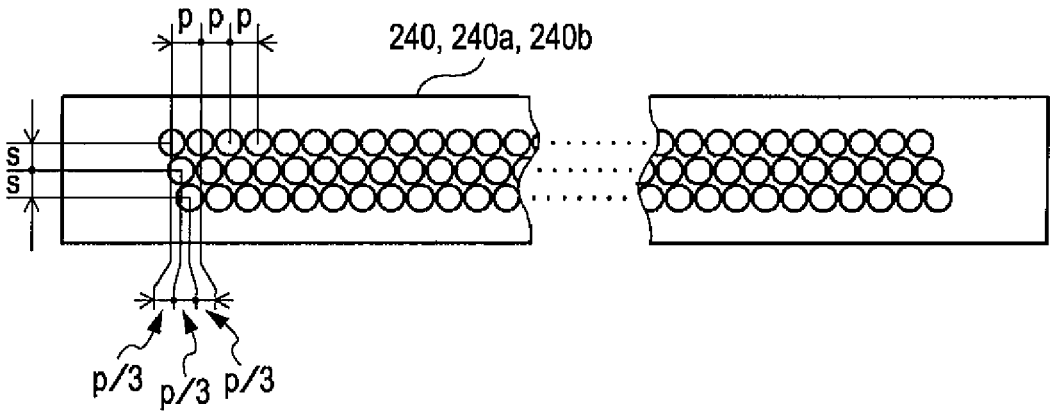
FIGS. 5A and 5B are explanatory views illustrating arrangement of a plurality of imaging lenses provided on a lens array plate.
Figure 5B:
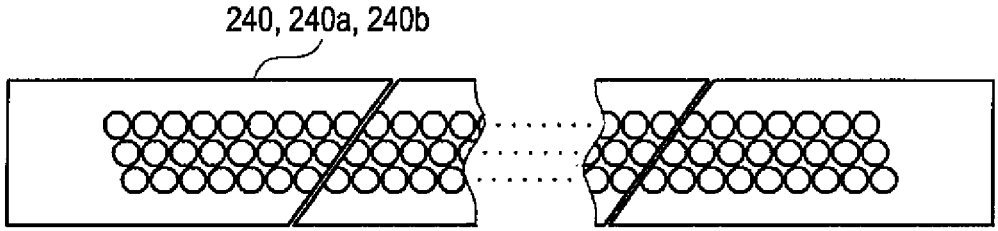

Further, the lens array plate 240 may be configured as shown in FIG. 5A as an integral component over its entire length or configured as shown in FIG. 5B to include several lens array plates 240 which are divided into short lens array plate and combined as one. With this divided type lens array plate 240, even when the length of the lens array plate 240 is changed, it is possible to easily correspond by adding to the center lens array plate 240.

Figure 6:
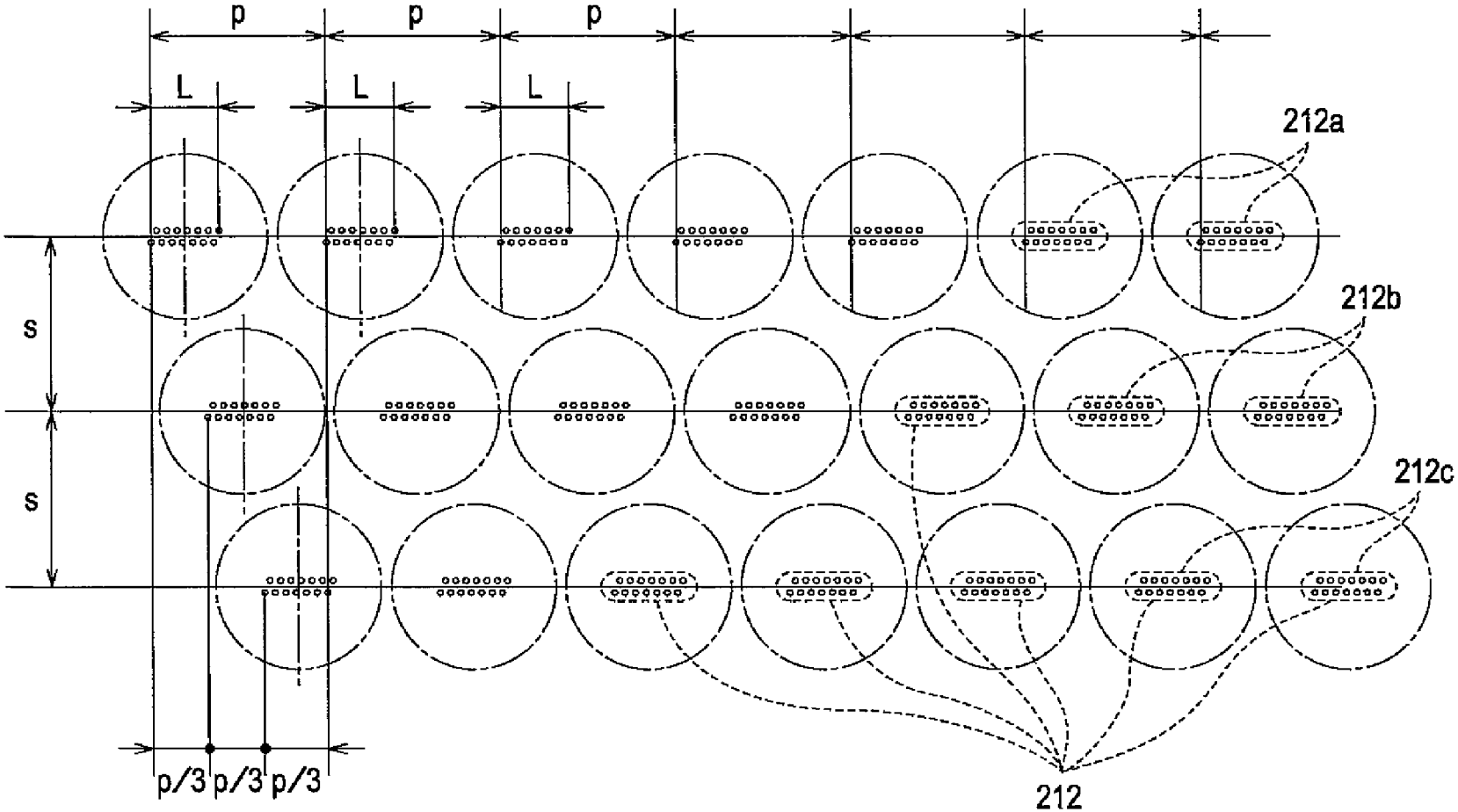
FIG. 6 is an explanatory view illustrating a view in which a plurality of light emitting element arrays is arranged on a light emitting element substrate.

FIG. 6 is an explanatory view illustrating a view in which a plurality of light emitting element arrays 212 are arranged on a light emitting element substrate 210. FIG. 6 shows a view of a light emitting element array 212 disposed on a light emitting element substrate 210 observed from a direction of a lens array plate 240. Also, FIG. 6 shows an imaging lens in a light dot and dash line is used to illustrate a positional relationship with regard to an imaging lens formed on a lens array plate 240. Moreover, for convenience of understanding, the specification describes that the imaging optical system is an optical system of the same magnification or a magnified optical system. With regard to other optical systems, although there occurs a case in which the spot-shaped latent images formed on a photoconductive drum 102 are overlapped, the arrangement of light emitting elements 213 on a light emitting element substrate 210 is not overlapped. However, if the latent images on a photoconductive drum 102 are arranged as shown in FIG. 6, any arrangement of the light emitting element 213 on a light emitting element substrate 210 is allowed.

As shown in FIG. 6, the light emitting element array 212 is configured such that a plurality of light emitting elements are linearly arranged. A center distance between the light emitting elements at both ends is "L". An arrangement of the light emitting elements constituting a light emitting element array 212 will be discussed afterwards with reference to other figures. Also, the light emitting element array 212 is arranged to be the center of the imaging lens. As described with reference to FIGS. 5A and 5B, the imaging lenses are arranged in a lens pitch p and the adjacent lines of the imaging lenses are separated by a distance s. Similarly, with regard to the light emitting element array 212, three array lines in which a plurality of light emitting element arrays 212 are arranged in a pitch p are separated from each other by a distance s. Also, each array line is arranged with a phase deviation corresponding to one third of the lens pitch "p". Hereinafter, particularly in a case in which it is necessary to distinguish the light emitting element arrays 212 constituting each array line, they will be respectively denoted as a light emitting element array 212*a*, a light emitting element array 212*b* and a light emitting element array 212*c*.

Figure 7:
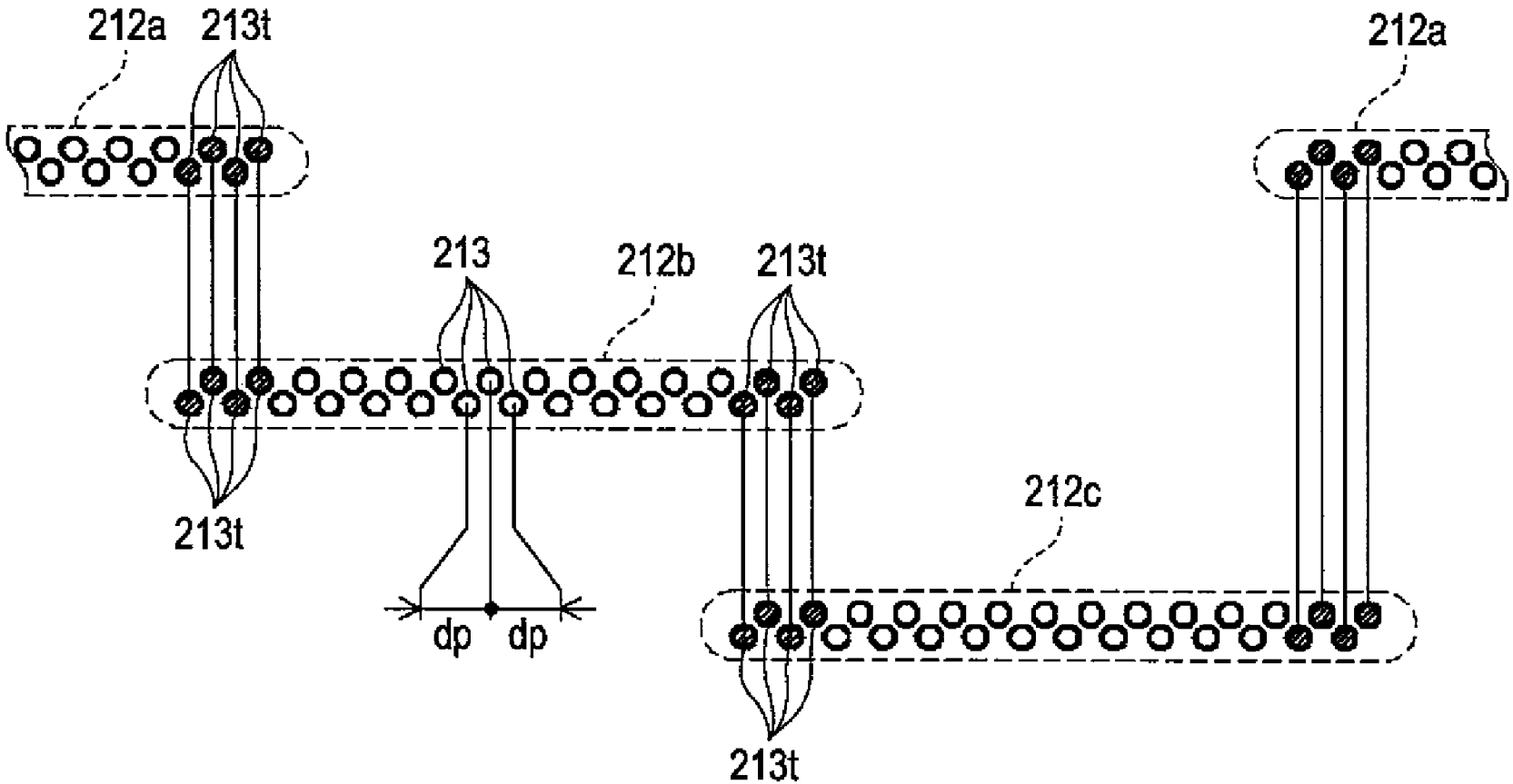
FIG. 7 is an explanatory view illustrating an arrangement of the light emitting elements constituting a light emitting element array.

FIG. 7 is an explanatory view illustrating an arrangement of the light emitting elements 213 constituting a light emitting element array 212. As shown in FIG. 7, the light emitting element array 212 according to the embodiment is constituted by twenty eight light emitting elements 213 arranged in a zigzag pattern. A distance between each light emitting elements 213 is set to be "dp". For convenience of illustration, in FIG. 7, the distance between three array lines is shown to be narrower than actual scale.

Further, when looking at three array lines in a direction perpendicular to the array line, the light emitting element arrays 212 constituting each array line and the light emitting element arrays 212 constituting another array line are arranged at a position at which ends of the light emitting element arrays 212 are overlapped. For example, as shown in FIG. 7, four light emitting elements 213 provided at an end of the light emitting element array 212*a* are overlapped with four light emitting elements 213 provided at an end of the light emitting element array 212*b*. Also, four light emitting elements 213 provided at the other end of the light emitting element array 212*b* are overlapped with light emitting elements 213 provided at an end of the light emitting element array 212*c*. Additionally, four light emitting elements 213 provided at the other end of the light emitting element array 212*c* are overlapped with light emitting elements 213 provided at an end of the light emitting element array 212*a*. Hereinafter, among the light emitting elements 213 constituting a light emitting element array 212, the light emitting elements 213 overlapped with other light emitting element array 212 are referred to as overlapped elements 213*t*. In FIG. 7, these overlapped elements 213*t* are marked with diagonal lines.

Further, the light emitting element array 212 shown in FIG. 7 is constituted by combining two lines of light emitting elements arranged in a constant pitch. By combining the light emitting elements 213 so that they are arranged at different positions from each other, a pitch "dp" is realized over the whole of these light emitting elements 213. Of course, the number of lines of the light emitting element is not limited to two. It may be allowed to configure the light emitting element array 212 by combining more lines of light emitting elements with a slight deviation. With this configuration, it is possible to realize a finer pitch over the whole of the light emitting elements 213 constituting the light emitting element array 212.

B. Summary of Forming a Latent Image

Figure 8A:
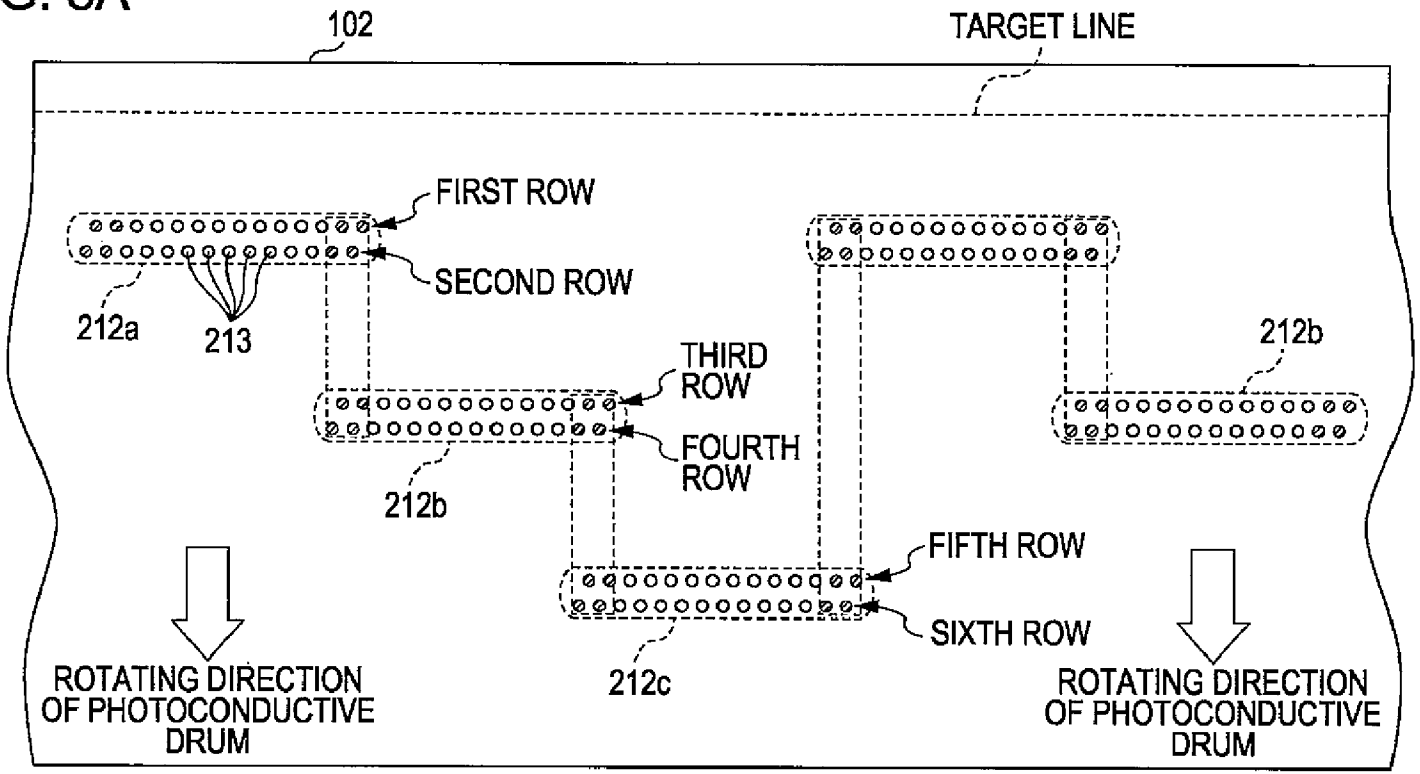
FIGS. 8A and 8B are explanatory views schematically illustrating a method of forming a latent image on a surface of a photoconductive drum using an exposure head.
Figure 8B:
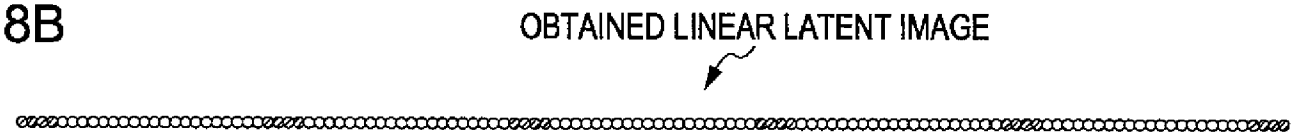

FIGS. 8A and 8B are explanatory views schematically illustrating a method of forming a latent image on a surface of a photoconductive drum 102 using an exposure head 200 with the above-described configuration. In FIGS. 8A and 8B, focusing on five lines of light emitting element array 212, a positional relationship between each light emitting element 213 constituting these light emitting element arrays 212 and the photoconductive drum 102 is shown. Through rotation of the photoconductive drum 102, a surface of the photoconductive drum 102 moves from top to bottom on a plane of paper. Also, on a target line indicated by using a bold broken line in FIGS. 8A and 8B, a linear latent image is formed. For convenience of illustration, in FIGS. 8A and 8B, a distance s between the light emitting element array 212*a* and the light emitting element array 212*b*, and a distance s between the light emitting element array 212*b* and the light emitting element array 212*c* are shown to be narrower than actual scale. Also, a diameter of the photoconductive drum 102 is shown to be smaller than actual scale.

Through rotation of the photoconductive drum 102, the target line on a surface of the drum moves downwards and adjacently to the light emitting element array 212*a*. Since the light emitting element array 212 is constituted by two lines of light emitting elements 213 as described above with reference to FIG. 7, the target line 212 shown in a broken line first reaches one side line of the light emitting elements 213. Hereinafter, two lines of light emitting elements constituting the light emitting element array 212*a* will be referred to as "the first line" and "the second line" from a side which is near to the target line. Similarly, the lines of the light emitting elements constituting the light emitting element array 212*b* will be referred to as "the third line" and "the fourth line" from a side which is near to the target line, while the lines of the light emitting elements constituting the light emitting element array 212*c* will be respectively referred to as "the fifth line" and "the sixth line".

If a target line on a surface of the drum reaches the light emitting elements of the first line through rotation of the photoconductive drum 102, the light emitting elements 213 constituting the first line are all brightened together. Then, lights from the light emitting elements 213 are collected by the imaging lens of the primary lens array plate 240*a* and the secondary lens array plate 240*b*, focused on a surface of the photoconductive drum 102 and form a small latent image of a spot shape at that position. As a result, the latent images of spot shapes are formed at scattered positions on a target line in correspondence to arrangement of the light emitting elements of the first line 213.

In this way, after the latent image is formed by the light emitting elements of the first line 213, if the target line reaches a position of the light emitting elements of the second line 213 through rotation of the photoconductive drum 102, the light emitting elements of the second line 213 are all brightened together. As a result, a latent image of a spot shape is formed by the light emitting elements of the second line 213 between the latent images of spot shapes formed by the light emitting elements of the first line 213. Again, if the target line reaches the light emitting elements of the third line 213 constituting the light emitting element array 212*b* through rotation of the photoconductive drum 102, the light emitting elements of the third line 213 are all brightened together. Subsequently, if the target line reaches the light emitting elements of the fourth line 213, the light emitting elements of the fourth line 213 are all brightened together. As a result, the latent images by the light emitting elements of the third line 213 and the light emitting elements of the fourth line 213 are formed.

Further, as described above with reference to FIG. 7, at an end of each light emitting element array 212, the overlapped elements 213*t*, which are overlapped with the light emitting elements 213 of the other light emitting element array 212, are provided. In FIGS. 8A and 8B, the overlapped elements 213*t* are shown as being surrounded by a broken line of rectangular shape. With regard to these overlapped elements 213*t*, either side of them may be brightened. Similarly, with regard to the light emitting elements 213 constituting the light emitting element array 212*c*, if the target line reaches the light emitting elements of the fifth line 213, the light emitting elements of the fifth line 213 are all brightened together. Subsequently, if the target line reaches the light emitting elements of the sixth line 213, the light emitting elements of the sixth line 213 are all brightened together. As a result, as shown in FIG. 8B, a linear latent image in which the latent images of spot shapes are linearly arranged in a pitch dp can be formed on a surface of the photoconductive drum 102.

As described above, it is possible to form a desired latent image on a surface of the photoconductive drum 102 by brightening the light emitting elements 213 at an appropriate timing according to the movement of the photoconductive drum 102. Of course, this is a case in which the exposure head 200 has been assembled to the photoconductive drum 102 with substantially negligible error. In a case in which the exposure head 200 is obliquely assembled (in a case in which a so-called skew has occurred), the situation is slightly different.

Figure 9:
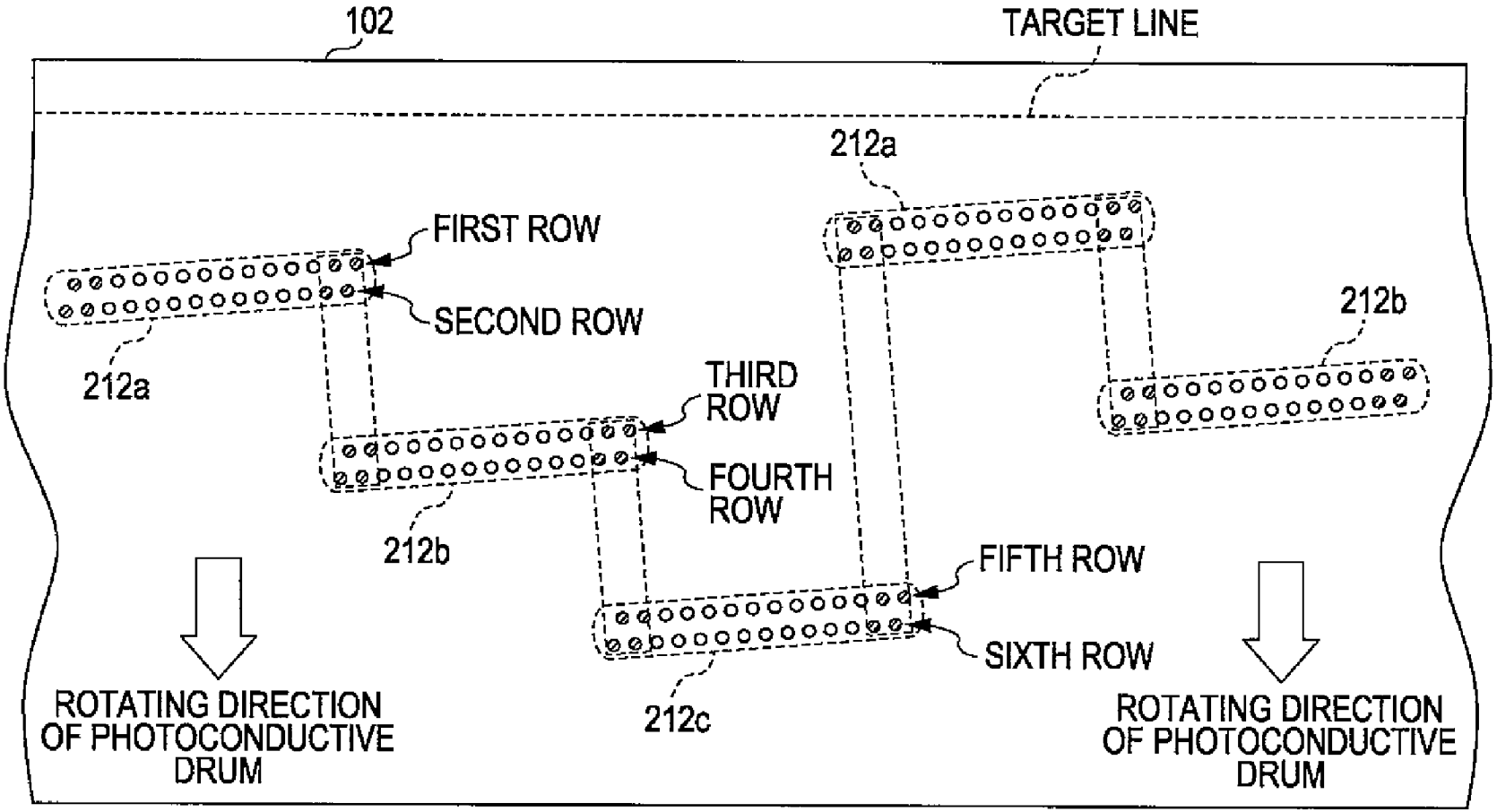
FIG. 9 is an explanatory view illustrating a case in which an exposure head is assembled so as to be obliquely positioned in respect to the photoconductive drum.

FIG. 9 is an explanatory view illustrating a case in which an exposure head 200 is assembled so as to be obliquely positioned in respect to the photoconductive drum 102. If the exposure head 200 is inclined with respect to a target line on the photoconductive drum 102, the light emitting element arrays 212 are also inclined with regard to the target line. As a result, since the target line reaches the light emitting elements of the first line 213 from the end thereof in order, the light emitting elements of the first line 213 are not all brightened together. In other words, it is necessary to brighten the respective light emitting elements 213 at appropriate timing according to the order in which they reach the target line. As for the light emitting elements 213 of the second to sixth lines, similarly, the light emitting elements of each line 213 cannot be all brightened together, and it is necessary to brighten the light emitting elements at appropriate timing according to the order in which they reach the target line.

As described above, it is possible to form a latent image in which spots are linearly arranged by each of the light emitting elements 213, by adjusting the timing of the brightening the respective light emitting elements 213. However, since there is a skew due to the oblique light emitting array 212, a space between the spots becomes narrower than a pitch dp which is an original space. Actually, the pitch dp is an extremely small value, and the slope of the exposure head 200 is also small. Therefore, it does not in effect raise a problem, but there is a problem at positions on a boundary line between two light emitting element arrays 212. In other words, since a space among an array line of the light emitting element array 212*a*, an array line of the light emitting element array 212*b*, and an array line of the light emitting element array 212*c* is significantly larger than the pitch dp between the light emitting elements 213, as described above with reference to FIG. 6, there is a problem even if the exposure head 200 is assembled in a slight oblique state.

Also, in the embodiment shown in FIG. 9, a space between the light emitting element array 212*a* and the light emitting element array 212*b* is widened by inclining the exposure head 200, so that the space between the spots at the portion are not dense. In the same reason, there also occurs a portion, between the light emitting element array 212*b* and the light emitting element array 212*c*, in which spaces between the spots are not dense. Conversely, a space between the light emitting element array 212*c* and the light emitting element array 212*a* is narrowed, so that the spaces between the spots at the portion are dense. As a result, spots which are dense or not dense are arranged on the latent image formed on a surface of the photoconductive drum 102 in a constant period. Accordingly, toner sections which are dense or not dense appear on the image formed by the latent image, thereby deteriorating the image quality.

Also, as shown in FIG. 5B, in a case in which a long lens array plate 240 is formed by connecting the short lens array plates 240, if a positioning error happens at a time of connection, the position of the entire spots formed by the short lens array plate 240 is out of alignment. Consequently, such a problem may happen at the connection portion of the lens array plate 240.

The image forming apparatus 1 according to this embodiment can avoid such a problem by brightening the overlapped elements 213*t* provided at the end portions of the light emitting element arrays 212 in a special distribution of an amount of light.

C. Method of Driving an Exposure Head in the Embodiment

Figure 10:
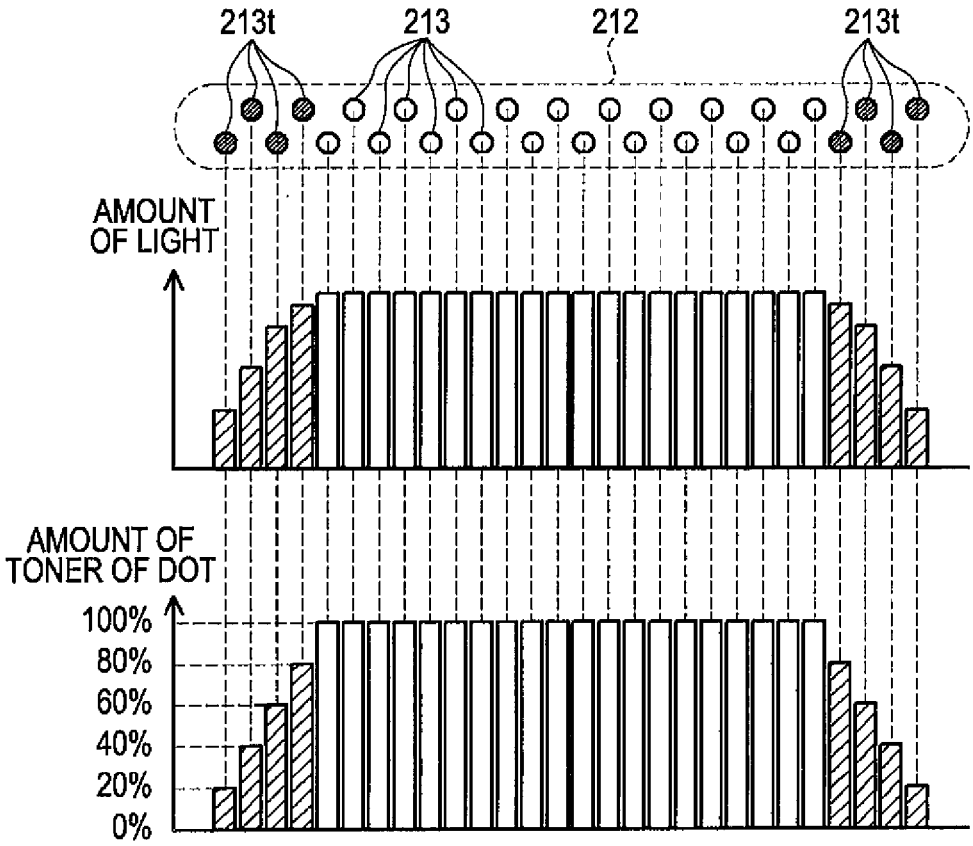
FIG. 10 is an explanatory view illustrating a distribution of an amount of light of each light emitting element in a light emitting element array.

FIG. 10 is an explanatory view illustrating the distribution of an amount of light of each light emitting element 213 employed in the exposure head 200 according to the embodiment. FIG. 10 shows the distribution of an amount of light for each of the light emitting elements 213 (and the overlapped elements 213*t*) constituting one light emitting element array 212. Although the light emitting array 212 is provided at its end portion with a plurality of overlapped elements 213*t* in the exposure head 200 according to the embodiment as described above, the overlapped elements 213*t* are set in such a way that an amount of light becomes smaller towards the overlapped element at an end portion. Also, a reduction rate of the amount of light at this time is set in consideration of the following.

First, as described above with reference to FIG. 4, if the light emitting element 213 is brightened, the light is collected by an imaging lens of the lens array plate 240, so that the latent image of spot shape is formed on the surface of the photoconductive drum 102. Toner is transferred to such formed latent image by the developing unit 130, as described above with reference to FIG. 2, so that a toner image is formed on the surface of the photoconductive drum 102. In a case in which there is a large amount of light from the light emitting element 213, a large latent image is formed on the surface of the photoconductive drum 102, and thus an amount of the toner adhered to the surface of the photoconductive drum is increased. Conversely, if there is a small amount of light from the light emitting element 213, a small latent image is formed on the surface of the photoconductive drum 102, and thus an amount of the toner adhered to the surface of the photoconductive drum 102 is decreased. After the toner image formed on the surface of the photoconductive drum 102 is transferred to the transfer belt 22, as described above with reference to FIG. 1, it is transferred to the printing paper so as to print an image of small dots. In consequence, the amount of the toner finally transferred to the printing paper is increased or decreased in response to the amount of light from the light emitting element 213.

In the exposure head 200 according to the embodiment, the amount of light of each overlapped element 213*t* is set such that the amount of toner for the dots finally printed on the printing paper due to the brightening of the overlapped elements 213*t* is substantially linearly decreased towards an end side overlapped element. For example, in the exposure head 200 according to the embodiment, since both ends of the light emitting element array 212 are respectively provided with four overlapped elements 213*t*, the amount of toner is set so as to be linearly decreased by about 80%, about 60%, about 40%, and about 20% towards the end side overlapped element 213*t* with regard to the amount of toner 100% by a general light emitting element 213 which is not the overlapped element 213*t*. In the exposure head 200 according to the embodiment, since the distribution of the amount of light of the overlapped element 213*t* is set in such a way that the amount of toner is substantially linearly decreased towards the end side overlapped element. 213*t*, a complementary relationship is established between the overlapped elements 213*t* which are overlapped each other. The relationship between the amount of light from the light emitting element 213 and the amount of toner transmitted to the printing paper is not simply proportional. Accordingly, although there is a relationship such that as the amount of toner is substantially linearly decreased, the amount of light from the light emitting element 213 is decreased, but the amount of light does not linearly decreased. In this embodiment, the distribution of the amount of light by which the amount of toner is linearly decreased is set by experimental approach.

Figure 11:
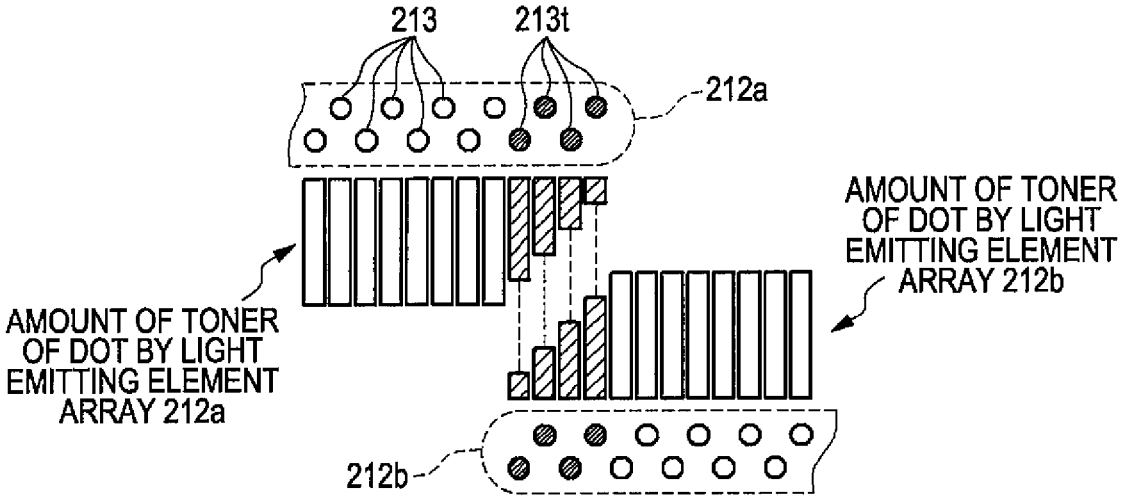
FIG. 11 is an explanatory view illustrating that there is a complementary relationship between the overlapped elements in an exposure head according to the embodiment.

FIG. 11 is an explanatory view illustrating the state that there is a complementary relationship between the overlapped elements 213*t* which are overlapped each other in the exposure head 200 according to the embodiment. In FIG. 11, the amount of toner for each dot formed by the light emitting element array 212*a* and the amount of toner for each dot formed by the light emitting element array 212*b* are shown. Also, the overlapped elements 213*t* and the amount of toner for the dot by the overlapped elements 213*t* are marked with diagonal lines. Although the amount of toner for the dot formed by the overlapped elements 213*t* is decreased towards the end side overlapped element 213*t* as described above, the amount of decrease is supplemented by another overlapped element 213*t* which is overlapped with the overlapped element 213*t*. To explain in detail with reference to FIG. 11, for example, in the light emitting element array 212*a*, focusing on the overlapped element 213*t* positioned adjacent to the general light emitting element 213, the decreased amount of toner in the overlapped element 213*t* is slightly smaller relative to the general light emitting element 213. The overlapped element 213*t* which is overlapped with the overlapped element 213*t* which is being focused on is the overlapped element 213*t* which is positioned at the far end of the light emitting element array 212*b*, and the amount of toner for the dot by this element is small. Accordingly, if the amount of toner for the dot by the overlapped element 213*t* which is being focused on is added to the amount of toner for the dot by the overlapped element 213*t* which is overlapped with the element, the resultant amount is substantially equal to the amount of toner for a dot by the general light emitting element 213 which is not the overlapped element 213*t*. In this specification, when such a relationship is established between the overlapped elements 213*t* which are overlapped with each other, it is said that "these overlapped elements 213*t* are in a complementary relation".

Further, in the exposure head 200 according to the embodiment, the configuration, in which the amount of toner is substantially linearly reduced towards the end side overlapped element 213*t*, is not limited to the overlapped element 213*t* which is being focused on, but is applied to all overlapped elements 213*t*. Accordingly, in the exposure head 200 according to the embodiment, the complementary relationship is established for all overlapped elements 213*t*. In the exposure head 200 according to the embodiment, since the section of the amount of light of the overlapped elements 213*t* is set to establish such a relationship (the amount of light is decreased towards the end side overlapped element, and a substantially complementary relationship is established between the overlapped elements 213*t*), it is possible to avoid degradation of the image quality due to the effect such as the inclination (so-called skew) of the exposure head 200 shown in FIG. 9.

In order to obtain the effect, it is not necessary to establish the exactly complementary relationship between the overlapped elements 213*t* which are overlapped with each other, and it is enough to establish an approximate complementary relationship between the overlapped elements. In other words, it is not required for the sum of the amount of toner as a result of combining the overlapped elements 213*t* which are overlapped with each other to correctly correspond to the amount of toner for the general light emitting element 213. If the amount of toner is nearly equal, the sufficient effect can be obtained.

Figure 12A:
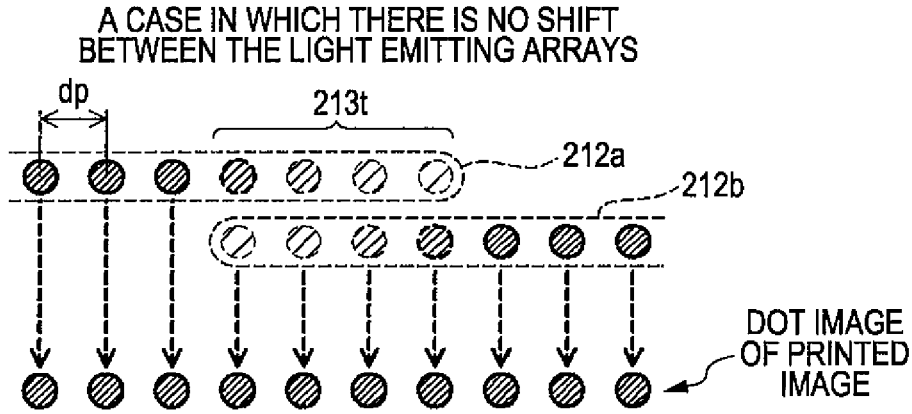
FIGS. 12A to 12C are explanatory views illustrating the reason why a good latent image can be formed in the exposure head according to the embodiment.
Figure 12B:
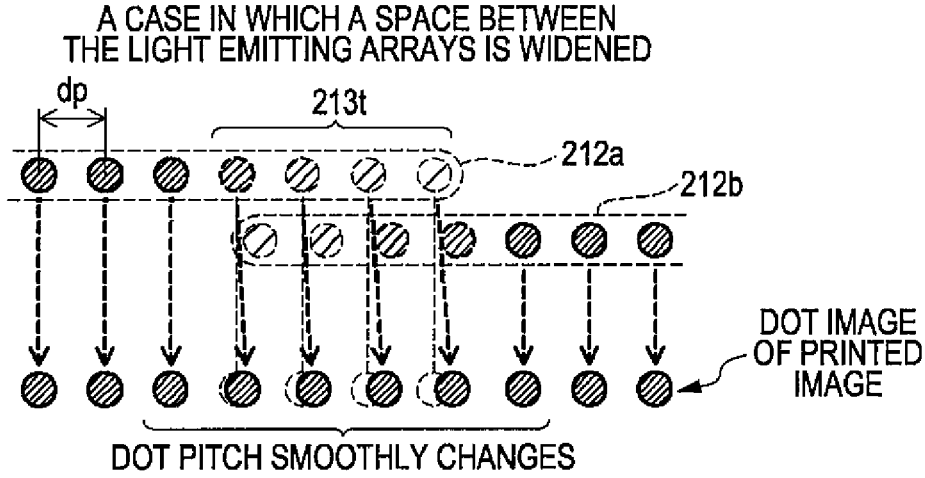
Figure 12C:
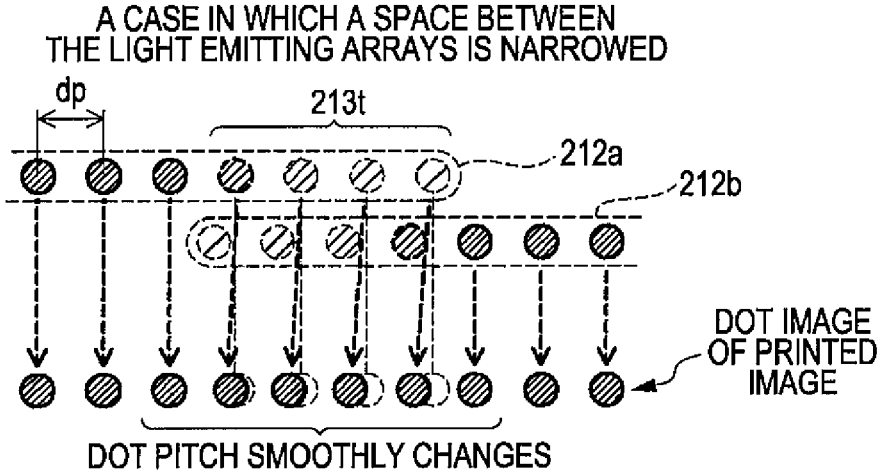

FIGS. 12A to 12C are explanatory views illustrating the reason why a good latent image can be formed without degradation of print image quality even in a case in which spaces between the light emitting element arrays 212 are varied due to the influence of the inclination of the exposure head 200. Of course, without being limited to the case in which the exposure head 200 is obliquely assembled, and the same effect can be obtained even in a case in which when the long lens array plate 240 is formed by connecting the short lens array plates 240 as shown in FIG. 5B, there is a positioning error at a connected portion.

FIG. 12A shows a state in which a linear image is printed in an ideal case where there is no deviation between the light emitting element arrays 212. Although the light emitting elements 213 are arranged in a zigzag pattern in the light emitting element array 212, as described above with reference to FIG. 8, a positional difference of the photoconductive drum 102 in a rotation direction is absorbed by adjusting the light emitting timing when the latent image is formed. Thus, in FIG. 12, for convenience of explanation, the light emitting elements 213 are linearly arranged in the light emitting element array 212.

In a case in which there is no position deviation between the light emitting element array 212, as shown in FIG. 12A, since the overlapped elements 213*t* of two light emitting element arrays 212 are overlapped with each other, it is possible to form the latent image at a substantially identical positions on the photoconductive drum 102 by brightening the light emitting elements at an appropriate timing. Also, as described above with reference to FIG. 11, the overlapped elements 213*t* are set in a substantially complementary relationship so that the amount of toner for the dot formed on the printing paper by two overlapped elements 213*t* is substantially equal to the amount of toner for the dot formed by the general light emitting elements 213. As a result, the image finally formed on the printing paper becomes an ideal image in which a plurality of dots are linearly arranged at a constant pitch dp.

However, as described above with reference to FIG. 9, in a case in which the exposure head 200 is obliquely assembled (i.e., a skew occurs) or the positioning error happens when the short lens array plates 240 are connected together, there are portions in which the space between the light emitting element arrays 212 is widened or narrowed.

FIG. 12B shows a state in which a linear image is printed at a portion in which a space between the light emitting element arrays 212 is widened (the light emitting element array 212*b* is shifted away from the light emitting element arrays 212*a*). In this case, since the space between the light emitting element arrays 212 is widened, the overlapped elements 213*t* of two light emitting element arrays 212 are not overlapped with each other, and form the latent image of spot shape at a slightly deviated position. It may be considered that the deviation amount between the overlapped elements 213*t* is equal for 4 pairs of the overlapped elements 213*t*.

The deviation amount between the overlapped elements 213*t* is equal for each pair, but a ratio of the amount of toner is different for each pair. For example, in a pair of the overlapped element 213*t* (the upper element in the figure) at the most center of the light emitting element array 212*a* and the first overlapped element 213*t* (the lower element in the figure) at the far end of the light emitting element array 212*b*, the amount of toner for the upper overlapped element 213*t* occupies most of the ratio. Accordingly, although the dot formed on the printing paper by the pair of the overlapped element 213*t* is substantially formed at a position corresponding to the upper overlapped element 213*t*, it is slightly affected by the lower overlapped element 213*t*. Therefore, it will be visually recognized by a human that the dot is formed at a position slightly deviated in the direction of the lower overlapped elements 213*t*. Of course, since the overlapped elements 213*t* are in a complementary relationship to each other, the overall amount of toner by the overlapped elements 213*t* is substantially equal to that of dot by the general light emitting elements 213. Thus, it will be conceived that the size of the dot is equal to that of the general dot.

The same configuration as the above description is also applied to an adjacent pair, that is, a pair of the overlapped elements 213*t* constituted by a second overlapped element 213*t* from a center in a direction of the light emitting element array 212*a* and a second overlapped element 2131 from the far end of the light emitting element array 212*b*. Compared with the above described pair, the amount of toner by the overlapped element 213*t* at the upper side in the figure is slightly decreased, while the amount of toner by the overlapped element 213*t* at the lower side in the figure is slightly increased. Therefore, although the dot is roughly formed at a position corresponding to the upper overlapped element 213*t*, it will be visually recognized by a human that the dot is formed with more deviation in a direction of forming the dot by the lower overlapped element 213*t*.

Further, in the next adjacent pair, a ratio of the amount of toner by the overlapped element 213*t* at the upper side in the figure and the amount of toner by the overlapped element 213*t* at the lower side in the figure is reversed, whereby the amount of toner at the lower side overlapped element is increased. Therefore, it will be visually recognized by a human that the dot is formed at a position more adjacent to the position corresponding to the overlapped element 213*t* at the lower portion in the figure rather than a position corresponding to the overlapped element 213*t* at the upper side in the figure. In the final pair, the amount of toner by the lower overlapped element 213*t* occupies most of the ratio. Thus, it will be visually recognized by a human that although the dot is formed at a position corresponding to the lower overlapped element 213*t*, it is slightly deviated in the direction of the upper overlapped element 213*t*.

In a portion of the overlapped element 213*t*, with a result that the dot is formed as described above, it is possible to smoothly connect a portion in which the dot is formed by only the light emitting element array 212*a* and a portion in which the dot is formed by only the light emitting array 212*b* while gradually changing the pitch of the dots formed by the overlapped elements 213*t*. Therefore, even in a case in which the space between the light emitting element array 212*a* and the light emitting element array 212*b* is widened, it is possible to print the image of high quality which does not allow any recognition of the widened space.

A substantially same configuration is also established to a portion that the space between the light emitting element arrays 212 is narrowed (the light emitting element array 212*b* approaches to the light emitting element array 212*a*). FIG. 12C shows a state in which a linear image is printed at a portion in which a space between the light emitting element arrays 212 is narrowed. In this case, the overlapped elements 213*t* of two light emitting element arrays 212 are not overlapped with each other, and form the latent image of spot shape at a slightly deviated position. Also, it may be considered that the deviation amount between the overlapped elements 213*t* is equal for all pairs of the overlapped element 213*t*.

First, focusing on a pair of the overlapped element 213*t* (the upper element in the figure) at the most center of the light emitting element array 212*a* and the first overlapped element 213*t* (the lower element in the figure) at the far end of the light emitting element array 212*b*, the amount of toner by the upper overlapped elements 213*t* occupies the most ratio in the pair of the overlapped element 213*t*. Therefore, it will be visually recognized by a human that although the dot is roughly formed at a position corresponding to the upper overlapped element 213*t*, the dot is formed at a position slightly deviated in a direction of the lower overlapped element 213*t*.

In an adjacent pair, that is, a pair of the overlapped elements 213*t* constituted by a second overlapped element 213*t* from a center in a direction of the light emitting element array 212*a* (the upper element in the figure) and a second overlapped element 213*t* from an end of the light emitting element array 212*b* (the lower element in the figure), a ratio of the amount of toner by the upper overlapped element 213*t* is decreased, and a ratio of the amount of toner by the lower overlapped element 213*t* is increased. Therefore, it will be visually recognized by a human that the position of the dot is largely deviated in a direction corresponding to the lower overlapped element 213*t*. In addition, in the adjacent pair, the deviation amount becomes larger. In the final pair, it will be conceived that the dot is formed at a position slightly deviated in a direction of the upper overlapped element 213*t* from a position corresponding to the lower overlapped element 213*t*. As a result, in a portion at which the space between two light emitting element arrays 212 is narrowed, it is possible to gradually change a pitch of the dot formed by the overlapped element 213*t* between the portion in which the dot is formed by only one side of the light emitting element array 212 and the portion in which the dot is formed by only the other side of the light emitting element array 212. Therefore, even in such a portion, it is possible to print the image of high quality without any consciousness of the narrowed space of the light emitting element array 212.

As described above in detail, in the exposure head 200 according to the embodiment, since the amount of light of the overlapped element 213*t* provided at the end portion of the light emitting element array 212 becomes smaller towards the end side overlapped element, the overlapped elements 213*t* which are overlapped with each other are in a substantially complementary relationship (see FIG. 11). As a result, although the sections in which the space between the light emitting element arrays 212 is widened or narrowed are generated, it is possible to form a good latent image by the above-described mechanism without degradation of the image quality in the sections.

D. Summary of Data Processing

Figure 13:
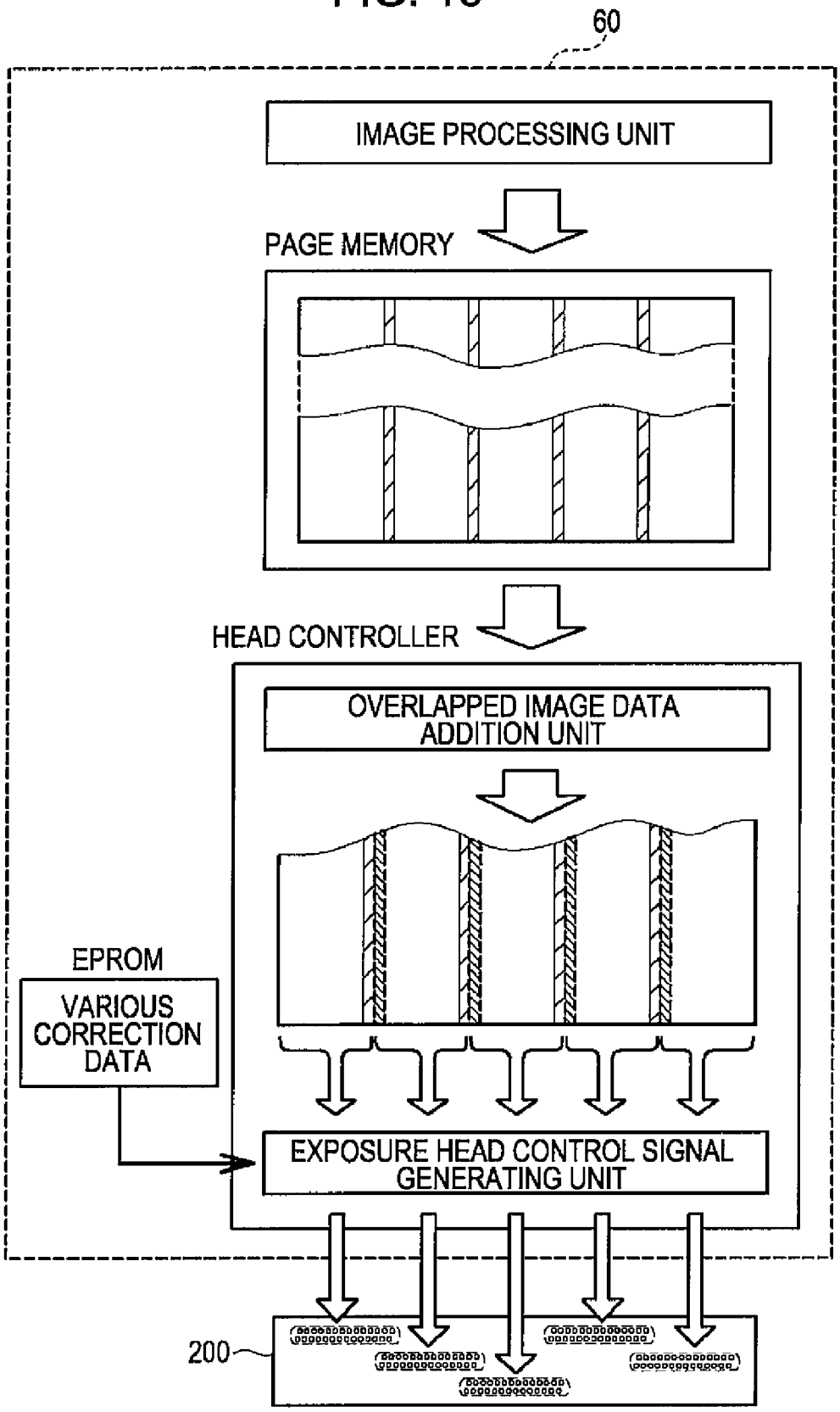
FIG. 13 is an explanatory view schematically illustrating data processing which is performed in a control unit of an image forming apparatus.

The image forming apparatus 1 according to the embodiment executes the following data processing in the control unit 60 in order to drive the exposure head 200 by the above-described method. FIG. 13 is an explanatory view schematically illustrating data processing which is performed in a control unit 60 of an image forming apparatus 1. The control unit 60 is provided with a memory region (page memory) for storing the image data for one page to be printed as a bit image. The image data of bit image is the following data. As described above, the image forming apparatus 1 according to the embodiment lights the light emitting element 213 provided on the exposure head 200, forms a latent image of a spot shape on a surface of the photoconductive drum 102, transfers the toner image by the latent image and forms a dot of the toner on a printing paper, whereby an image is printed. Accordingly, all of the images are printed by forming small dots of toner in an appropriate distribution. The image data of bit image is data in which an image to be printed is segmented into small regions each of which is referred to as a pixel having a size corresponding to one dot and whether the dot is formed for every each pixel or not is indicated.

The bit image data can be created by executing several image processing beginning with so-called halftone processing with regard to the image data to be printed. If the image forming apparatus 1 according to the embodiment reads the image data to be printed from an external memory medium (or a computer, etc.), the image data is converted into bit image data in the image processing unit provided in the control unit 60, and then the obtained data is stored in the page memory. Also, in the case of printing color images, it is preferable to separate the colors in the image data into each color component such as yellow, magenta, cyan and black, and then execute an image processing with regard to the image data of each color component.

The bit image data stored in the page memory is subsequently supplied to the "overlapped image data addition unit" of the head controller provided in the control unit 60. The overlapped image data addition unit, first, segments the bit image data into the portions formed by the overlapped elements 213*t* and the portions not formed by the overlapped elements. Since the arrangement of the light emitting element array 212 in the exposure head 200 is previously known, the data can be simply segmented. FIG. 13 shows the portions formed by the overlapped elements 213*t* which are marked with thick diagonal lines. As described above with reference to FIG. 12, the bit image data of the portion marked with thick diagonal lines is printed by using two light emitting element arrays 212. Thus, the same bit image data is inserted into a position adjacent to the bit image data of the portion marked with thick diagonal lines. FIG. 13 shows the inserted bit image data marked with thin diagonal lines. The bit image data for each light emitting array 212 is created by inserting the bit image data of the portion formed by the overlapped element 213*t*.

Such created bit image data for each the light emitting element array 212 is subsequently supplied to the "exposure head control signal generating unit" in the head controller, and then is converted into a signal (an exposure head control signal) for driving each light emitting element 213 (and the overlapped element 213*t*) in the exposure head 200. As described with reference to FIGS. 7 to 9, since each light emitting element 213 is disposed at a position deviated in a rotation direction of the photoconductive drum 102, the exposure head control signal is created in consideration of the difference in the light-emitting timing due to the position deviation. Further, the difference in the light-emission intensity due to the manufacturing variance or time degradation of each light emitting element 213 (and the overlapped element 213*t*), also can be corrected when the exposure head control signal is created. For example, the light emitting element 213 with low light emission intensity is corrected such that a driving current of the element is increased.

The data (inclination amount of the exposure head 200 or variance in an amount of light of each light emitting element) required for the correction is measured when the image forming apparatus 1 is shipped, and then is previously stored in the EPROM in the control unit 60. Further, various correction data stored in the EPROM may be updated by printing a dedicated test pattern at a predetermined time (e.g., power input timing of the image forming apparatus 1) and detecting the obtained image by a dedicated sensor.

Further, as shown in FIG. 10, the exposure head 200 according to the embodiment is set in such a way that an amount of light decreases towards the end side overlapped element 213*t* of the light emitting array 212. In response to this, in the exposure head control signal generating unit, the control signal for driving the overlapped element 213*t* may be corrected so that the driving current of the element is decreased to make the amount of light smaller towards the end of the light emitting element array 212. Also, the correction data for decreasing the amount of light of the overlapped element 213*t* may be processed in a similar manner to the correction data to correct the light emission intensity due to the manufacturing variance or the like, and then be stored in the EPROM. However, as it is clear from FIG. 10 or FIG. 11, in regard to the correction to decrease an amount of light of the overlapped elements 213*t*, it is determined in a part-designed manner and the need for updating the correction data is low. Thus, it may be possible to store the correction data into a non-rewritable ROM or assemble it into a circuit using a resistor and the like.

With such a configuration, the light emitting element 213 (and the overlapped element 213*t*) in each light emitting element array 212 is driven by supplying the control signal generated for each light emitting element array 212 from the exposure head control signal generating unit to the exposure head 200. As such, in a portion of the overlapped element 213*t*, the amount of toner linearly decreases towards the end of the light emitting element array 212, and the dots are formed to establish a complementary relationship between the overlapped elements 213*t* which are overlapped with each other. As a result, for example, even though there are the portions in which a space between the light emitting element arrays 212 is widened or narrowed, and the portions in which a pitch between the dots is widened or narrowed, it is possible to form an image of high quality by the mechanism described with reference to FIG. 12, without being affected by the above description.

Although the image forming apparatus 1 and the exposure head 200 according to the embodiment are described, the present invention is not limited to the above embodiment. Various variations can be made without departing from the spirit or scope of the invention.

The entire disclosure of Japanese Patent Applications No. 2008-308261, filed on Dec. 3, 2008 is expressly incorporated by reference herein.

What is claimed is:

1. An exposure head comprising:

a group of light emitting elements in which light emitting elements are arranged in a first direction;

a light emitting element substrate in which the group of light emitting elements and a different group of light emitting elements are arranged in the first direction and in a second direction orthogonal or substantially orthogonal to the first direction; and a driving substrate which drives the light emitting elements arranged on the light emitting element substrate, wherein the driving substrate controls a light emission intensity of a light emitting element that is near to a first end side in the first direction in the group of light emitting elements, so that the intensity is smaller than a light emission intensity of a complementary light emitting element that is near to a second end side in the first direction in the different group of light emitting elements, and the light emission intensity becomes smaller towards the first end side, a distance between the group of light emitting elements and the different group of light emitting elements is widened or narrowed in the first direction, and an overall light emission intensity of the group of light emitting elements along the first direction decreases non-linearly.

2. The exposure head of claim 1, wherein the widened distance is shifted away from each other so as to form a deviation amount between overlapped light emitting elements.

3. The exposure head of claim 1, wherein the narrowed distance is shifted closer to each other so as to form a deviation amount between overlapped light emitting elements.

4. The exposure head of claim 1, wherein a spot shape is formed at a deviated position.

5. The exposure head of claim 1, wherein a distance between the complementary light emitting elements of the group of light emitting elements and the different group of light emitting elements increases or decreases along the first direction among different complementary light emitting element pairs.

6. An image forming apparatus comprising:

a latent image carrier on which a first latent image is formed;

an exposure head including a first group of light emitting elements in which light emitting elements are arranged in a first direction, a first imaging optical system which images the first group of light emitting elements, a second group of light emitting elements which emit light to form a second latent image which is partly overlapped with the first latent image formed on the latent image carrier by the light from the first group of light emitting elements by the first imaging optical system, and a second imaging optical system which images the second group of light emitting elements; and a driving control unit which controls an amount of light from the light emitting elements which emit light to be imaged at a position at which the first latent image and the second latent image are overlapped such that its light emission intensity is smaller than that of an amount of light from the light emitting elements which emit light to be imaged at a position at which the first latent image and the second latent image are not overlapped, wherein a distance between the first group of light emitting elements and the second group of light emitting elements is widened or narrowed in the first direction, and an overall light emission intensity of the group of light emitting elements along the first direction decreases non-linearly.

7. The image forming apparatus according to claim 6, wherein the driving control unit includes:

an image data reading unit which reads an image data;

a bit image data generating unit which generates bit image data which is data indicating a pixel which forms a bit on the basis of the image data; and a bit image data converting unit which detects overlapped dot bit image data which is emitted by the light emitting elements of the first group of the light emitting elements which emits a light to be imaged at a position at which a first latent image and a second latent image are overlapped, among the bit image data generated in the bit image data generating unit, generates the same data as the detected overlapped dot bit image data, and inserts it into the bit image data which is emitted by the light emitting elements of the second group of the light emitting elements which emits a light to be imaged at a position at which a first latent image and a second latent image are overlapped, whereby the bit image data of the second group of light emitting elements is converted.

* * * * *